US006346802B2

(12) United States Patent
Lasalandra et al.

(10) Patent No.: US 6,346,802 B2
(45) Date of Patent: Feb. 12, 2002

(54) CALIBRATION CIRCUIT FOR A BAND-GAP REFERENCE VOLTAGE

(75) Inventors: Ernesto Lasalandra, Montu' Beccaria; Nicola Bagnalasta, Ziano Piacentino, both of (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 09/862,651

(22) Filed: May 21, 2001

(30) Foreign Application Priority Data

May 25, 2000 (IT) ..... MI00A1154

(51) Int. Cl.[7] ..... G05F 3/16
(52) U.S. Cl. ..... 323/313; 323/315
(58) Field of Search ..... 323/312, 313, 323/314, 315

(56) References Cited

U.S. PATENT DOCUMENTS 4,525,663 A * 6/1985 Henry ..... 323/280
4,808,908 A 2/1989 Lewis et al.
5,325,045 A 6/1994 Sundby
5,596,265 A * 1/1997 Wrathall et al. ..... 323/315
5,805,011 A * 9/1998 Comino ..... 327/563
6,060,874 A * 5/2000 Doorenbos ..... 323/316
6,094,041 A * 7/2000 Wachter ..... 323/315

* cited by examiner

*Primary Examiner*—Adolf Deneke Berhane
(74) *Attorney, Agent, or Firm*—Hogan & Hartson, LLP

(57) ABSTRACT

The present invention relates to a calibration circuit for a band-gap voltage comprising first and second transistors working at different current density, having the base electrodes connected to each other, a first resistance connecting the emitter electrodes of said first and second transistors, said first transistor having a second resistance in series with its emitter electrode, said first and second transistors being connected with a circuitry of transistors, configured as a mirror, characterized by comprising a current source, generating a current in function of the value present in a digital word, composed by "i" bit, connected by means of first and second switches to respective first and second circuit nodes so as to select in which node to insert the current and so as to select the necessary quantity of current to make the calibration.

7 Claims, 2 Drawing Sheets

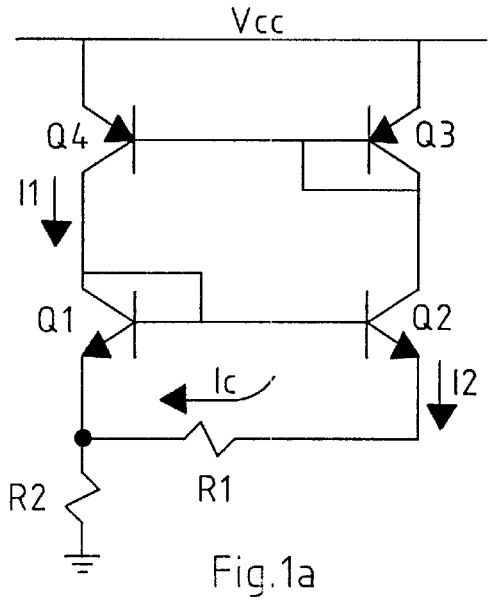
Fig.1a
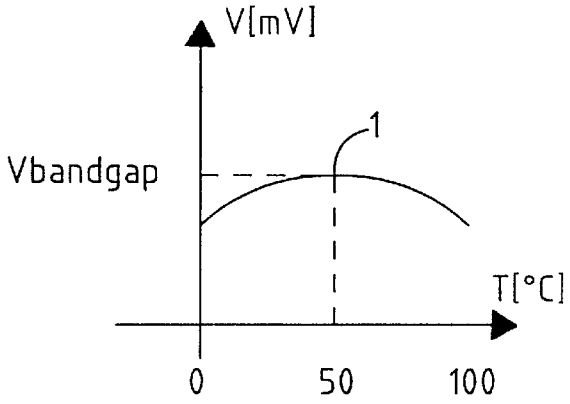
Fig.1b
Fig.2
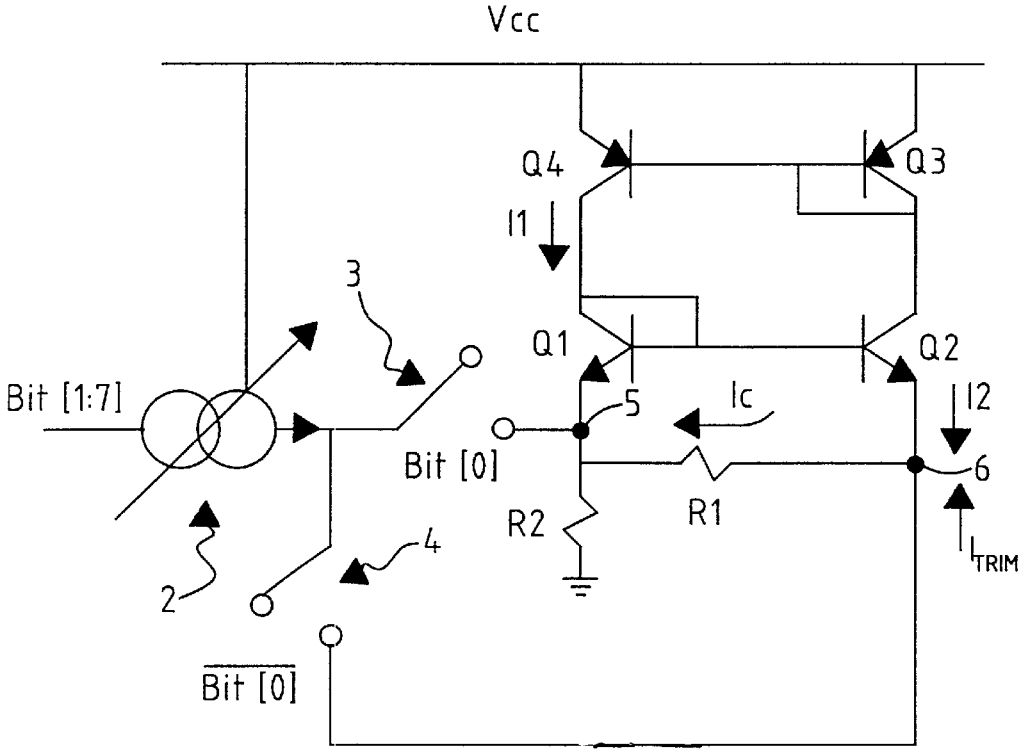

CALIBRATION CIRCUIT FOR A BAND-GAP REFERENCE VOLTAGE

DESCRIPTION

The present invention relates to a calibration circuit for a band-gap reference voltage, particularly in integrated circuits implemented by BiCMOS technology.

Particular band-gap reference voltage circuits, adapted to provide a voltage, called band-gap reference voltage, for a good way of working of analog and integrated circuits are known to provide a reference as constant as possible with the change of the working temperature and of the supply voltage.

It is known from the physics of the semiconductor devices that the base-emitter voltage Vbe of a transistor decreases of about 2 millivolt each centigrade degree and by extrapolating the function until the zero Kelvin (0 K=−273.15° C.) it gets that Vbe of silicon transistors is 1.205 V, that is exactly the band-gap reference. Therefore by summing to said band-gap voltage a voltage which grows with the same law with the increase of the temperature, the resulting voltage remains constant at the value of the band-gap voltage.

Band-gap reference circuits generally use two transistors implemented by bipolar transistors, working at different current values, and said circuits use further devices adapted to develop a voltage proportional to the difference of the two base-emitter voltages, called ΔVbe, of said transistors.

In the prior art, in order to obtain this result, the bases of the two transistors are usually connected to each other and a resistance connects their emitter in such a way as to detect the differences between the Vbes, so that it is possible to obtain a band-gap reference voltage as a weighted sum of voltages having opposite temperature coefficients, that is:

$$Vbandgap=Vbe+G*\Delta Vbe$$

wherein "Vbe" is the negative coefficient of the voltage of the base-emitter junction of a bipolar transistor and "G *ΔVbe" is a voltage having a positive temperature coefficient. In this way the resulting voltage, that is the reference or Vbandgap voltage, has a temperature coefficient equal to zero in the ideal case.

Conventional circuits of band-gap voltage reference are described in many technical—scientific literature books, including for instance P. R. Gray and R. G. Meyer, "Analysis and Design of Analog Integrated Circuit, Third Edition", McGraw Hill, 1994.

However imperfections of process can compromise the right way of working of the reference circuit and in particularly the equality of the two resistances used as weight, as well as the realization of other circuit devices necessary for the working of the band-gap reference circuit, such as, for example, a current mirror, is extremely delicate In the U.S. Pat. No. 4,808,908 in order to avoid the fluctuations of the band-gap voltage, as a consequence of process spreads, said voltage is regulated by means of resistances (resistances of devices such as, for example, Zener—zap or poly fuse) adapted to stabilize the output reference voltage of the circuit, and calibrated by the use of a laser.

In the U.S. Pat. No. 5,325,045 the band-gap voltage is regulated by means of a modification of the ratio of the number of the emitter electrodes, using more bipolars in parallel, so as to generate aΔVbe.

In view of the state of the art described, it is an object of the present invention to make insensitive the band-gap reference circuit to the working temperature changes and to the supply voltage fluctuations so as to guarantee a better calibration of the reference voltage. According to the present invention, such object is achieved by a calibration circuit for a band-gap voltage comprising first and second transistors working at different current density, having the base electrodes connected to each other, a first resistance connecting the emitter electrodes of said first and second transistors, said first transistor having a second resistance in series to its emitter electrode, said first and second transistors being connected with a circuitry of transistors, configured as a mirror, characterized by comprising a current source, generating a current in function of the value present in a digital word, composed by "i" bit, connected by means of first and second switches to respective first and second circuit nodes so as to select in which node to insert the current and so as to select the necessary quantity of current to make the calibration.

Thanks to the present invention it is possible to make a circuit able to minimize the area dissipation by reducing the number of used resistances.

Furthermore it is possible to make a circuit having at disposition a higher number of calibration levels with equal used bits.

It is also possible to make a circuit having a temperature behavior which is easily detectable and controllable, because any device is inserted in the electric path, adapted to generate the reference voltage.

The features and the advantages of the present invention will be made evident by the following detailed description of an embodiment thereof which is illustrated as not limiting example in the annexed drawings, wherein:

FIG. 1*a* shows a scheme of a band-gap voltage reference according to the prior art;

FIG. 1*b* shows a graph of the trend of the reference voltage in function of the temperature according to the scheme of FIG. 1*a;*

FIG. 2 shows a calibration system according to the invention;

Figure 3:
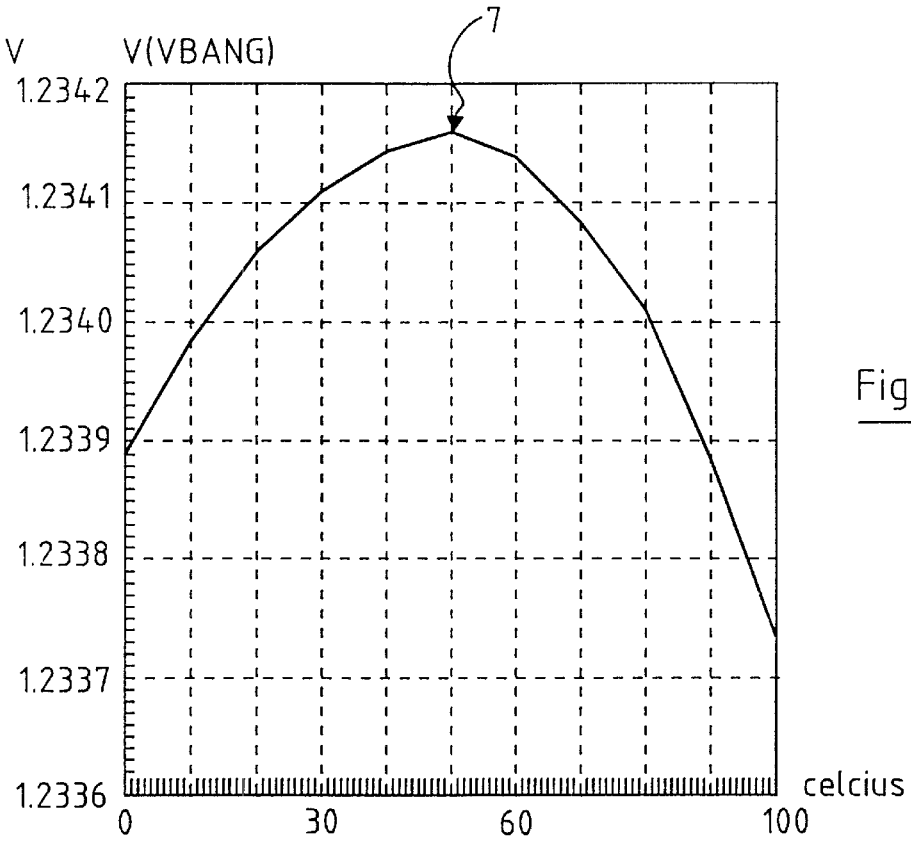
FIG. 3 shows a simulation of the circuit according to the present invention.

In FIG. 1*a* a scheme of a reference having a supply voltage Vcc, a couple of bipolar transistors Q3 and Q4, disposed so as to realize a current mirror configuration, to which a second couple of bipolar transistors Q1 and Q2 is connected, having the respective base electrodes connected to each other and the emitter electrodes connected to each other by means of a resistance R1 and disposed so as to realize a configuration known as Widlar, is shown.

It gets therefore that the current 12 flowing in the transistor Q2 depends on the following mathematical formula:

$$I2=V_T/R1*1n\ (n_e*Q_1/n_e*Q_2)*1n(n_e*Q_1/n_e*Q_2) \quad (1)$$

where $V_T$ is the thermal voltage.

Moreover there is also a resistance R2, disposed in series with said resistance R1 and connected to the ground, in which a current equal to the sum of the collector currents of the bipolar transistors Q1 and Q2 flows.

Generally the use of bipolar transistors, as heretofore described, allows to obtain band-gap reference voltages defined by the weighted sum of voltages having opposite temperature coefficients, that is:

$$Vbandgap=Vbe+G*\Delta Vbe \quad (2)$$

where:

$$Vbe=V_T*1n[I_C*T^{-\gamma}*E*\exp(V_{GO}/V_T)] \quad (3)$$

wherein $V_T=K*T/Q$ is the thermal voltage, $I_c$ is the collector current, E is a constant independent from the temperature, $V_{GO}$ is a band-gap voltage of the silicon at zero Kelvin degree and $\gamma$ is a parameter of the implementation technology of the circuit, having a value of about 3.

Whereas:

$$\Delta Vbe = Vbe1 - Vbe2 \quad (4)$$

wherein Vbe1 and Vbe2 are the respective voltage of the base emitter junctions of the transistors Q1 and Q2.

As a consequence, therefore:

$$\Delta Vbe = V_T * 1n(n_e) \quad (5)$$

wherein $n_e$ is the ratio among the number of the emitters of the transistors Q2 and Q1.

In the case of the scheme proposed in FIG. 1*a*, it is possible to deduce the following mathematical formula:

$$Vbandgap = Vbe + (2*R2/R1)*V_T*1n\ (n_e) \quad (6)$$

If the transistors, defining the couples Q1–Q2 and Q3–Q4 are equal, that is they are implemented by means of the same productive process, the current that flows in the mesh defined by the transistors Q1 and Q2 and by the resistance R1 is:

$$I_c = \Delta Vbe/R1 \quad (7)$$

By substituting the formula (7) in the formula (3) it is obtained:

$$Vbe = V_T \cdot 1n\ [K*T/(Q*R1)*1n\ (n_e)*T^{-\gamma}*E*exp\ (V_{GO}/V_T)] \quad (8).$$

If in the formula (8) the terms independent from the temperature are collected in a constant "B", that is B=K/(Q*R1)*1n ($n_e$), the formula (8) becomes:

$$Vbe = V_T*1n[B*T^{1-\gamma}*exp\ (V_{GO}/V_T)] \quad (9)$$

or similarly:

$$Vbe = V_{GO} + (K*T/Q)*1n\ (B*T^{1-\gamma}) \quad (10)$$

By doing, instead, the derivative of the formula (10) with respect to the temperature T, by supposing $\gamma>1$, the trend of the base emitter junction voltage of the bipolar transistor Q1 and/or Q2 is obtained in function of the temperature parameter T, that is it results:

$$(dVbe/dt) = (K/Q)*1n\ (B*T^{1-\gamma}) + [K/(B*Q)]*(1-\gamma) \quad (11)$$

The formula (11) has a negative derivative, that is it has a negative temperature coefficient.

By making the derivative of the formula (5) in function of the temperature T, it is obtained:

$$(d\Delta Vbe/dt) = (K/Q)*1n\ (n_e) \quad (12)$$

The formula (12) has a positive derivative, that is it has a positive temperature coefficient.

Therefore by making an opportunely weighted sum of the voltages Vbe and ΔVbe and by acting on the ratio between the resistances R1 and R2, it is ideally possible to obtain a band-gap reference voltage which is stable in temperature, that is it is possible to have a null derivative of the band-gap reference voltage at a prefixed temperature:

$$(dVbandgap/dt) = 0 \quad (13)$$

In FIG. 1*b* a graph of the formula (13) that shows an abscissa axis representing the temperature expressed in Celsius degree and an ordinate axis representing the voltage expressed in millivolt, is shown.

As shown in such a graph a point 1 is noted wherein at a prefixed temperature, for example the design temperature, a horizontal tangent is depicted, and therefore the condition sustained by the formula (13) is verified.

The spreads of the process parameters as heretofore described do not allow to obtain a curve as that shown in FIG. 1*b*, curve that should be convex and should present voltage changes in the range of a millivolt on a ΔT of about 100° C.

To overcome this limit in FIG. 2 a calibration system according to the invention is shown, wherein same or like parts have same reference numbers.

According to what shown in such a Figure. a current source 2 connected to the supply voltage Vcc, adapted to control a couple of switches 3 and 4, is noted.

It is noted that the switch 3 is placed between said current source 2 and a point 5 of the band-gap reference circuit and the second switch 4 is connected between said current source 2 and a point 6 of said reference circuit.

The point 5 is the point in common among the terminals of the resistances R1 and R2 with the emitter electrode of the transistor Q1, whereas the point 6 is the point in common between the terminal of the resistance R1 and the emitter electrode of the transistor Q2.

In FIGS. 1*a* and 1*b* there is described what ideally has to be obtained, but in order to correct the errors of the process imperfections and in particularly the matching of the resistance R1 and R2 and also the realization of the current mirror Q3 and Q4, the present invention uses the current source 2 so that it is possible to act on the weight G.

The current source 2 is a source of the type ($\Delta Vbe/R_x$) and it has a circuit implementation well known to a skilled person. A source of such a nature generates a quantity of current in function of the value of a "i" bit digital word, that is in function of the trimming word.

Said source 2 then controls the action of the couple of switches 3 and 4, switches that can be implemented circuitally by N channel MOS transistors.

The insertion of the switches 3 and 4 therefore does not occur in the electric path adapted to generate the band-gap reference voltage and this is a remarkable advantage in the prediction of said voltage Vbandgap, because the ON and OFF resistances of said MOS switches show a trend hardly predictable in temperature.

Therefore in function of the sign of the loss of balance, that the reference voltage suffers as described by the formula (2), the source 2 is connected to one of the two nodes 5 or 6. This is realizable because the decision to connect a node or the other is contained in the value of the "i" bit digital word.

Moreover by using such a source 2, which is adjustable in current, it is possible to establish the current quantity to be injected into the selected node so as to determine the right calibration, because also the value of the calibration, in module and in sign, can be stored in said digital word.

In the particular embodiment of FIG. 2, the digital word has a dimension "i" =8 bit and it has been chosen to identify with the most significant bit of said digital word, that is Bit [0] or "i" =0, which node is to be connect and with the remaining bits, that is Bit [1:7] or the "i–1" bits, the value of the correction to be made.

By using said source 2, and by closing the switch 3 in function of the most significant bit of said digital word, a current injection in the circuit point 5 is realized and this eliminates eventual decreasing of the G factor, and therefore, a band-gap reference voltage is obtained, such as:

$$Vbandgap = Vbe + (\Delta Vbe * R2) * (2/R1 + 1/R_x) \quad (14)$$

This states that the source 2, intervening on the formula (14), realizes that the value of the derivative of said formula with respect to the temperature variable comes again to have a horizontal tangent at the temperature design value.

Vice versa, by closing the switch 4 in function, for example, of the negated value of the most significant bit of said digital word, a current injection in the circuit point 6 is made and this eliminates eventual decreasing of the G factor because the Applicant has found that it is not electrically convenient to take away current from the node 5, because it would be necessary to realize a non standard current source comprising several mirror stades with a consequent way of working which is hardly predictable and controllable in temperature. Otherwise by injecting current in the node 6 it gets that:

$$\Delta Vbe = R1 * (12 + I_{TRIM}) \quad (15)$$

wherein $I_{TRIM}$ is the current injected by the source 2.

Being ΔVbe constant, and by inserting $I_{TRIM}$ it gets that I2 decreases and said current 12 is mirrored in the transistor Q1. In substance a decreasing of the circulating current in the resistance R2 is obtained by decreasing the G weight and by centering the voltage Vbandgap in function of the value of $I_{TRIM}$.

Figure 4:
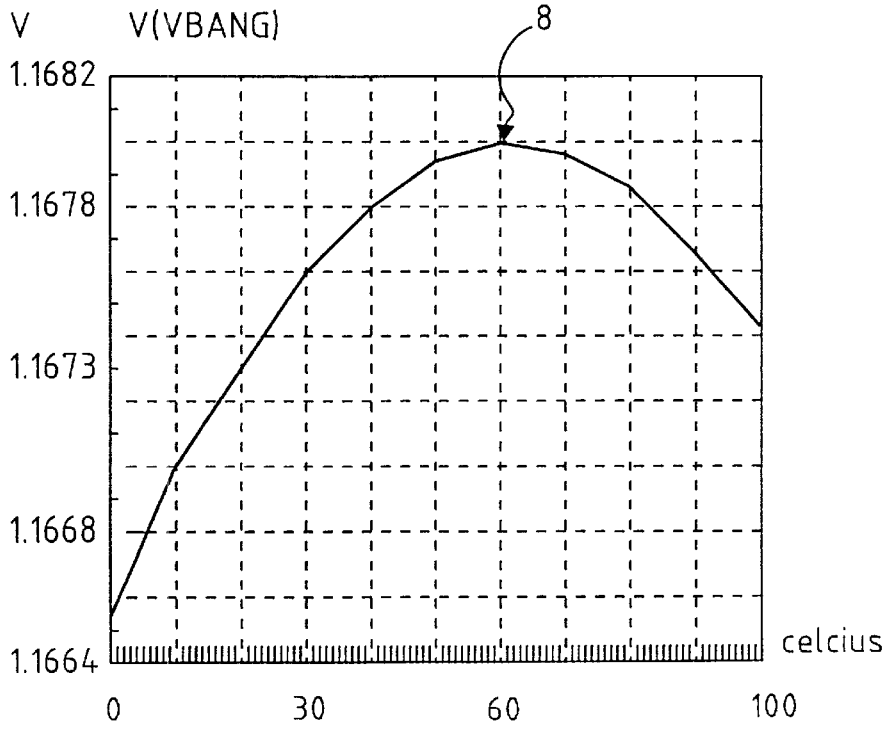
FIG. 4 shows another simulation of the circuit according to the present invention.

In FIGS. 3 and 4 two simulations of the circuit described in FIG. 2 are shown, having, in the case of FIG. 3, the parameters with lower stringent tolerances and, in case of FIG. 4, with higher stringent tolerances.

As shown in such Figures an abscissa axis indicating the temperature expressed in ° C. and an ordinate axis indicating the band-gap voltage expressed in volt are noted.

Both graphs show a convex curve having a point, respectively 7 and 8, with a horizontal tangent.

What is claimed is:

1. A calibration circuit for a band-gap voltage comprising first and second transistors working at different current density, having the base electrodes connected to each other, a first resistance connecting the emitter electrodes of said first and second transistors, said first transistor having a second resistance in series with its emitter electrode, said first and second transistors being connected with a circuitry of transistors, configured as a mirror, characterized by comprising a current source, generating a current in function of the value present in a digital word, composed by "i" bit, connected by means of first and second switches to respective first and second circuit nodes so as to select in which node to insert the current and so as to select the necessary quantity of current to make the calibration.

2. A calibration circuit according to the claim 1, characterized in that said current source is of a ΔVbe/R type, wherein ΔVbe is the difference of the base emitter voltages of the transistors placed in Widlar configuration and R is a resistance.

3. A calibration circuit according to the claim 1, characterized in that said generated current is a function of the variation of the circulating current in the mesh composed by said first and second transistor and by said first resistance.

4. A calibration circuit according to the claim 1, characterized in that the selection of the circuit node to be connected to said current source is a function of the value of the most significant bit of said digital word.

5. A calibration circuit according to the claim 1, characterized in that the selection of the quantity of the current ($I_{TRIM}$) to be inserted in said circuit nodes is a function of the less significant "i" bit of said digital word.

6. A calibration circuit according to the claim 1, characterized in that said first and second switches are implemented by N channel MOS transistors.

7. A calibration circuit according to the claim 1, characterized in that said current source and said circuitry configured as a mirror have a common voltage supply.

* * * * *